US009253858B2

(12) United States Patent
Kim et al.

(10) Patent No.: US 9,253,858 B2
(45) Date of Patent: Feb. 2, 2016

(54) LIGHTING NETWORK CONTROL APPARATUS AND METHOD

(71) Applicant: Electronics and Telecommunications Research Institute, Daejeon (KR)

(72) Inventors: Hyun-Jong Kim, Cheongju-si (KR); Tae-Gyu Kang, Daejeon (KR); You-Jin Kim, Daejeon (KR); Dae-Ho Kim, Daejeon (KR); Hyun-Seok Kim, Daejeon (KR); Sang-Kyu Lim, Daejeon (KR); Il-Soon Jang, Daejeon (KR); Jin-Doo Jeong, Daejeon (KR); In-Su Kim, Daejeon (KR); Seong-Hee Park, Daejeon (KR); Jung-Sik Sung, Daejeon (KR); Hyun-Chul Kang, Daejeon (KR); Myung-Soon Kim, Daejeon (KR); Hyun-Joo Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 308 days.

(21) Appl. No.: 13/916,047

(22) Filed: Jun. 12, 2013

(65) Prior Publication Data

US 2014/0139113 A1 May 22, 2014

(30) Foreign Application Priority Data

Nov. 22, 2012 (KR) ..... 10-2012-0132776

(51) Int. Cl.
*H05B 37/02* (2006.01)

(52) U.S. Cl.
CPC ..... *H05B 37/0245* (2013.01)

(58) Field of Classification Search
CPC ..... H05B 37/02
USPC ..... 315/291–294, 298, 307, 308, 323–324, 315/318; 345/156; 340/5.1, 5.2, 5.22, 3.5
See application file for complete search history.

(56) References Cited

U.S. PATENT DOCUMENTS

| | | | | |
|---|---|---|---|---|
| 7,550,931 | B2 * | 6/2009 | Lys et al. | 315/291 |
| 8,006,899 | B2 * | 8/2011 | Wein | 235/382 |
| 8,350,667 | B2 * | 1/2013 | Ferstl | 340/5.22 |
| 2005/0275626 | A1 * | 12/2005 | Mueller et al. | 345/156 |
| 2007/0291483 | A1 * | 12/2007 | Lys | 362/227 |

FOREIGN PATENT DOCUMENTS

| | | | |
|---|---|---|---|
| JP | 2012142181 | A | 7/2012 |
| KR | 1020060086577 | A | 8/2006 |

* cited by examiner

*Primary Examiner* — Dinh Le
(74) *Attorney, Agent, or Firm* — William Park & Associates Ltd.

(57) ABSTRACT

Disclosed herein are an apparatus and method for controlling a lighting network. The apparatus for controlling lighting network includes a control device and a plurality of control gears. The control device generates and transfers commands to control lighting. The plurality of control gears receives the commands from the control device and control lighting. The control device assigns a right to use a lighting network to the control gears, and the control gears send information about a change in a lighting state or error details to the control device using the right to use a lighting network.

14 Claims, 10 Drawing Sheets

LIGHTING NETWORK CONTROL APPARATUS AND METHOD

CROSS REFERENCE TO RELATED APPLICATION

This application claims the benefit of Korean Patent Application No. 10-2012-0132776, filed on Nov. 22, 2012, which is hereby incorporated by reference in its entirety into this application.

BACKGROUND OF THE INVENTION

1. Technical Field

The present invention relates generally to a lighting network control apparatus and method and, more particularly, to bidirectional lighting communication technology in which in a Digital Addressable Lighting Interface (DALI) protocol-based lighting network environment, each lighting control gear that has detected an error or a change in the lighting environment can make an error or situation report to a lighting control device.

2. Description of the Related Art

Existing DALI is a lighting control protocol that can be utilized in dimming systems for a conference room, a lecture hall, a shop and showroom of a department store, a museum, an exhibition space, a luxury room, etc. Existing DALI is based on a master-slave structure, and is thus configured such that each lighting control gear can be controlled using a command from a master and the master can report its state using only a query command.

In the meantime, the emotional state and work efficiency of humans may be highly affected by a lighting environment, and an existing DALI-based bidirectional communication scheme is limited in that it can neither actively deal with changes in the lighting environment nor provide an optimum lighting environment.

Therefore, there is a need for the development of bidirectional communication-based lighting control technology that can be used to check and collect control gear and lighting state information in a lighting control system almost in real time.

Japanese Unexamined Patent Application Publication No. 2012-142181 discloses a method of setting or changing an assigned information table for each user using a network and sending information about the control of a lighting apparatus to the main body of the lighting apparatus based on the information table. However, the technology disclosed in this Japanese patent application publication is limited in that it is impossible to check and collect control gear and lighting state information almost in real time.

SUMMARY OF THE INVENTION

Accordingly, the present invention has been made keeping in mind the above problems occurring in the prior art, and an object of the present invention is to provide a lighting network control apparatus and method in which the right to use a lighting network is transferred to a control gear whose lighting state or lighting environment has changed and lighting control gears actively report their states and the occurrence of errors, thereby achieving an optimum lighting state.

In accordance with an aspect of the present invention, there is provided a method of operating a lighting network control apparatus including a control device and a plurality of control gears, the method including assigning, by the control device, a right to use a lighting network to a first one of the control gears; checking, by the first control gear, whether there is data to be sent to the control device, and, if there is data to be sent, sending, by the first control gear, the data to the control device using the right to use a lighting network; and once the data has been sent, assigning, by the first control gear, the right to use a lighting network to another control gear.

The control gears may sequentially assign the right to use a lighting network among the control gears.

If the last one of the control gears possesses the right to use a lighting network, the last control gear may assign the right to use a lighting network to the control device.

Assigning, by the control device, the right to use a lighting network to the first one of the control gears may include assigning the right to use a lighting network by successively sending, by the control device, the address value of the first control gear to the first control gear.

The control device may operate in one of a mode which is capable of sending commands to the control gears, a mode in which the right to use a lighting network has been assigned to one of the control gears, and a mode in which a report on occurrence of a problem has been received from one of the control gears and a command to check the problem is transferred.

The control device and the control gears may change and set the value of cD_cflag, indicative of the possession of the right to use a lighting network, to 0 or 1 depending on the possession of the right to use a lighting network.

The control gears may each operate in one of a mode in which the right to use a lighting network is currently possessed by the control device, a mode in which the right to use a lighting network has been assigned to one of the control gears and a state report can be made, and in a mode in which the right to use a lighting network is currently possessed by the control gear and a state report cannot be made.

In accordance with another aspect of the present invention, there is provided an apparatus for controlling lighting, including a control device configured to generate and transfer commands to control lighting; and a plurality of control gears configured to receive the commands from the control device and to control lighting; wherein the control device assigns a right to use a lighting network to the control gears, and the control gears send information about a change in a lighting state or error details to the control device using the right to use a lighting network.

The control gears may sequentially assign the right to use a lighting network among the control gears.

If the last one of the control gears possesses the right to use a lighting network, the last control gear may assign the right to use a lighting network to the control device.

The control device may assign the right to use a lighting network to the first one of the control gears by successively sending the address value of the first control gear to the first control gear.

The control device may operate in one of a mode which is capable of sending commands to the control gears, a mode in which the right to use a lighting network has been assigned to one of the control gears, and a mode in which a report on occurrence of a problem has been received from one of the control gears and a command to check the problem is transferred.

The control device and the control gears may change and set the value of cD_cflag, indicative of possession of the right to use a lighting network, to 0 or 1 depending on the possession of the right to use a lighting network.

The control gears may each operate in one of a mode in which the right to use a lighting network is currently possessed by the control device, a mode in which the right to use a lighting network has been assigned to one of the control gears and a state report can be made, and in a mode in which the right to use a lighting network is currently possessed by the control gear and a state report cannot be made.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
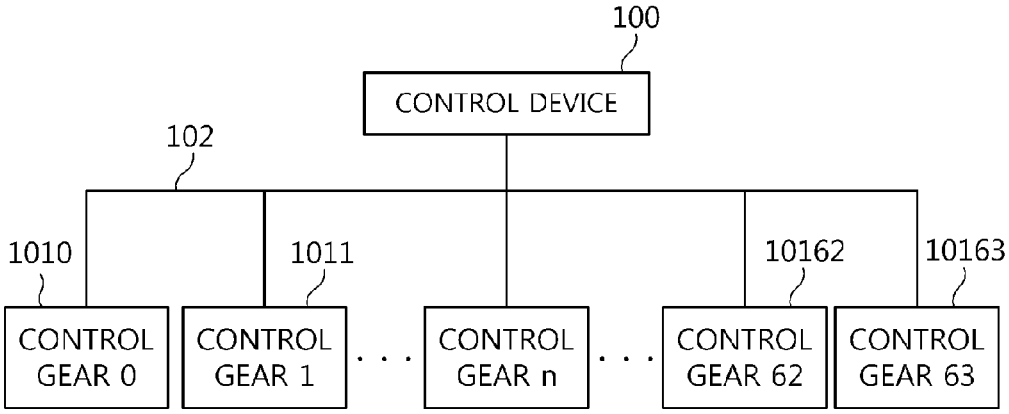
FIG. 1 is a diagram illustrating the configuration of a DALI-based lighting network that is controlled by a lighting network control apparatus according to an embodiment of the present invention.

The present invention will be described in detail below with reference to the accompanying drawings. Repeated descriptions and descriptions of known functions and constructions which have been deemed to make the gist of the present invention unnecessarily vague will be omitted below. The embodiments of the present invention are provided in order to fully describe the present invention to a person having ordinary knowledge in the art. Accordingly, the shapes, sizes, etc. of elements in the drawings may be exaggerated to make the description clear.

Embodiments of the present invention will be described in detail with reference to the accompanying drawings below.

FIG. 1 is a diagram illustrating the configuration of a DALI-based lighting network that is controlled by a lighting network control apparatus according to an embodiment of the present invention.

Referring to FIG. 1, the lighting network control apparatus according to this embodiment of the present invention may include a control device 100 configured to generate and transfer commands to control lighting, and a plurality of control gears 1010, 1011, 10162, and 10163 configured to receive commands to control lighting from the control device 100 and to then control lighting.

Here, the control device 100 and the control gears 1010, 1011, 10162, and 10163 transmit and receive lighting control signals over a DALI bus 102.

In this case, the control device 100 may assign the right to use a lighting network to the control gears 1010, 1011, 10162, and 10163 so that the control gears 1010, 1011, 10162, and 10163 can actively send their state information, unlike in a conventional DALI scheme.

For this purpose, the control device 100 notifies the control gears that the right to use the lighting network has been assigned by successively sending the first address value of the first one 1010 of the control gears twice.

The control gear 1010 at the first address, which has received the first address value, checks whether there is data to be transferred to the control device 100.

If there is no data to be reported, the control gear 1010 transfers the right to use the lighting network by sending the address of a subsequent control gear in order to assign the right to use the lighting network to the control gear 1011 having the subsequent address.

Through this series of steps, the lighting control gears have chances to report their states, and the control gear 10163 having the last address sends a 0x7F signal in order to return the right to use the lighting network to the control device 100.

Figure 2:
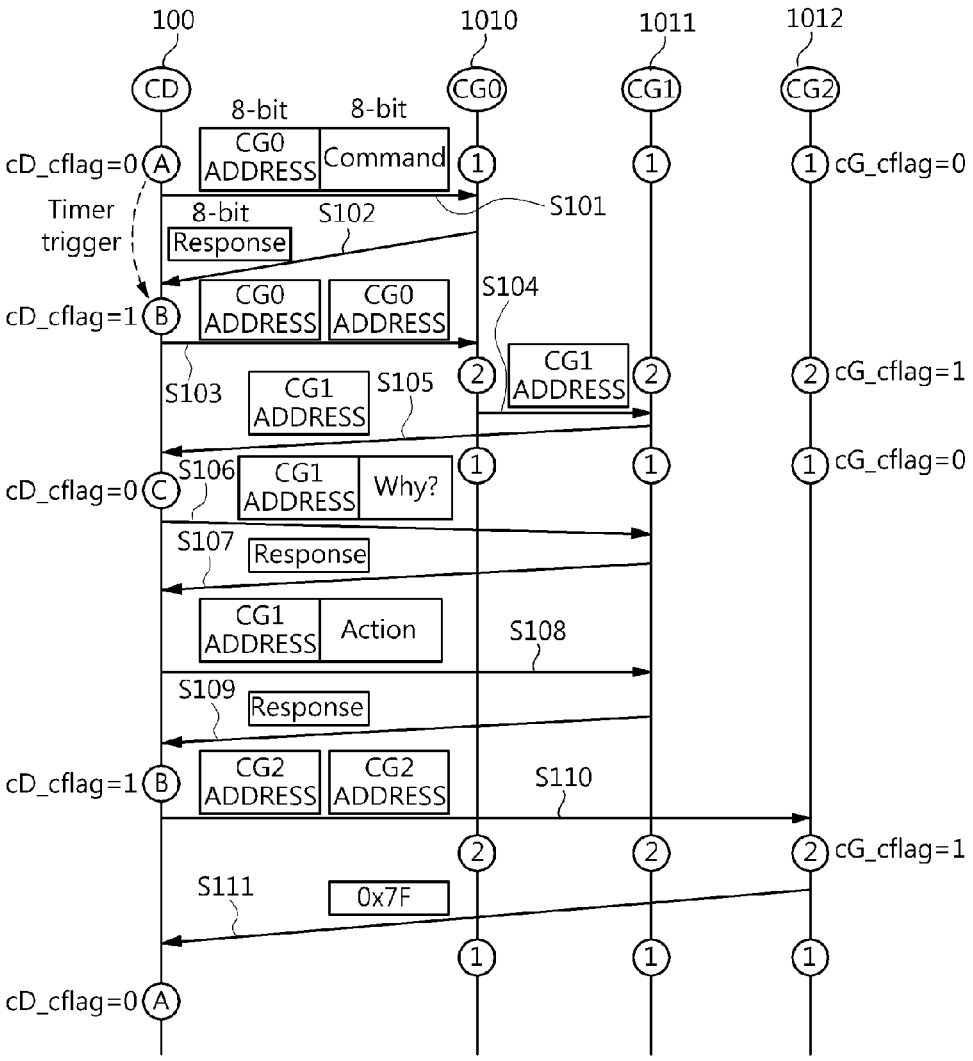
FIG. 2 is a drawing illustrating a message flow between a control device and control gears in a single control device environment according to an embodiment of the present invention.

FIG. 2 is a drawing illustrating a message flow between the control device and the control gears in a single control device environment according to an embodiment of the present invention.

The control device 100 may be in one of the state of possessing the right to use the lighting network and being able to send commands to the lighting control gears 1010, 1011, and 1012 (hereinafter referred to as "state A"), the state of having assigned the right to use the lighting network to one of the lighting control gears (hereinafter referred to as "state B"), and the state of receiving a report about the occurrence of a problem from one of the lighting control gears and transferring a command to check it (hereinafter referred to as "state C").

Similarly, each of the control gears may be in one of the state of the right to use the lighting network being possessed by the control device 100 (hereinafter referred to as "state 1"), the state of the right to use the lighting network having been assigned to one of the control gears and the control gear being able to make a state report (hereinafter referred to as "state 2"), and the state of the right to use the lighting network being possessed by one of the control gears and the control gear being unable to make a state report (hereinafter referred to as "state 3").

When the control device 100 in state A sends a command to control lighting to the control gear 0 1010 at step S101, the control gear 0 1010 in state 1, which has received the command, responds to the corresponding command at step S102.

If a predetermined period has elapsed and then the right to use the lighting network has been assigned to one of the control gears, the control device 100 successively sends the address of the control gear 0 1010 to use the lighting network twice and then transitions to state B at step S103.

The control gear 0 1010 having received its address twice becomes aware that it is its turn to use the lighting network, and transitions to state 2.

The control gear 0 1010 in state 2 checks whether there is data to be sent to the data control device 100, if there is no data to be sent, assigns the right to use the lighting network to the subsequent control gear 1 1011 by sending an address value obtained by adding 1 to its address, and transitions to state 3 at step S104.

As illustrated in FIG. 2, if there is data to be sent when the control gear 1 1011 is in state 2, the control gear 1 1011 sends its address to the control device 100, and the other control gears 1010 and 1012, having received the address, transition to state 1, and the control device 100 transitions to state C at step S105.

The control device 100 in state C queries whether the control gear 1 1011 has an error at step S106, and then receives a response thereto at step S107.

If there is a command related to this error, the control device 100 sends the command to the corresponding control gear at step S108, and then receives a response thereto, thereby becoming aware of a change in the lighting state and details of the error at step S109.

Thereafter, the control device 100 successively sends the address of the control gear 2 1012 that will use the lighting network twice at step S110, and thus the control gear 2 1012 has a chance to report its state. If there is no data to be reported, the control gear 2 1012 sends 0x7F in order to return the right to use the lighting network to the control device 100 at step S111.

Through this series of steps, the lighting control device can rapidly become aware of and deal with a change in the lighting environment.

Figure 3:
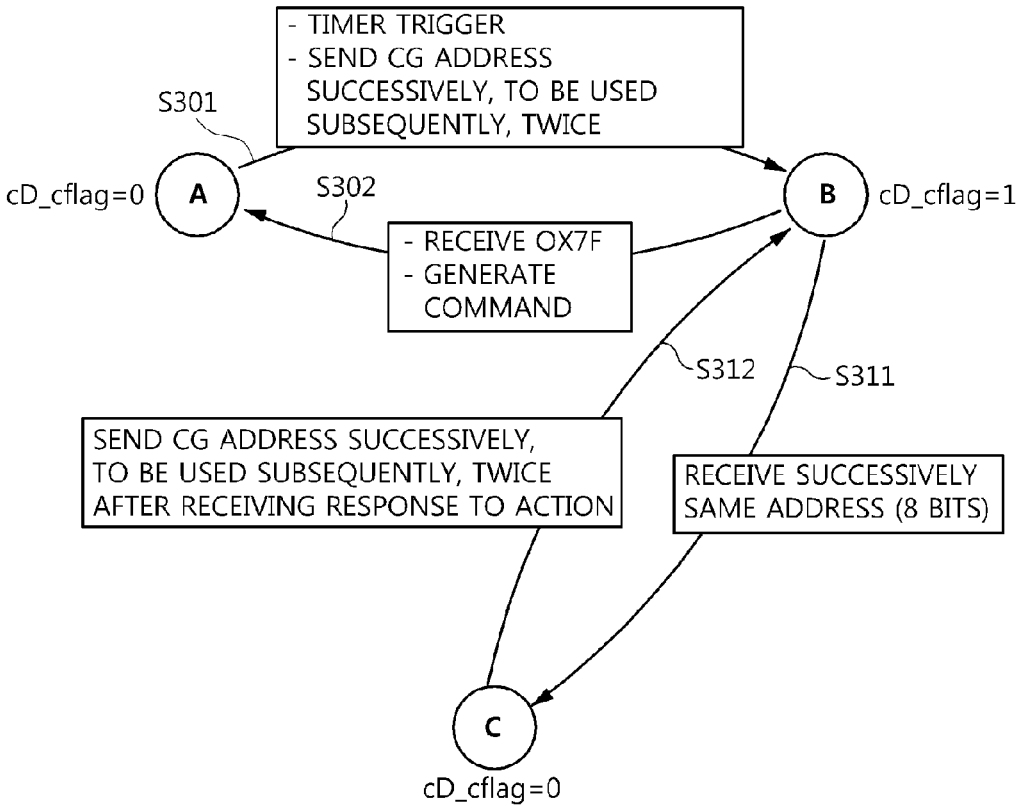
FIG. 3 is a diagram illustrating the state transition of the control device in a single control device environment according to an embodiment of the present invention.

FIG. 3 is a diagram illustrating the state transition of the control device in a single control device environment according to an embodiment of the present invention.

The control device 100 in state A sets cD_cflag to 0 in order to indicate that the right to use the lighting network is possessed by the lighting control device, and, if a timer that is used to assign the right to use the lighting network has been triggered or the address of a subsequent control gear has been successively sent twice, transitions to state B and sets cD_cflag to 1 in order to indicate that the right to use the lighting network has been possessed by the control gears at step S301.

Furthermore, the control device 100 in state B receives 0x7F from the control gear and, if there is a command to control lighting, returns to state A at step S302.

If the control device in state B have successively received the same 8-bit address, the control device becomes aware that the control gear having the corresponding address has data to be sent, sets cD_cflag to 0 in order to indicate that the right to use the lighting network is possessed by itself, and then transitions to state C at step S311.

Furthermore, after the control device in state C has received and dealt with the state information of the control gears, the control device successively sends the address of a subsequent control gear twice and transitions back to state B at step S312.

Under these conditions, the control device transitions among states A, B, and C.

Figure 4:
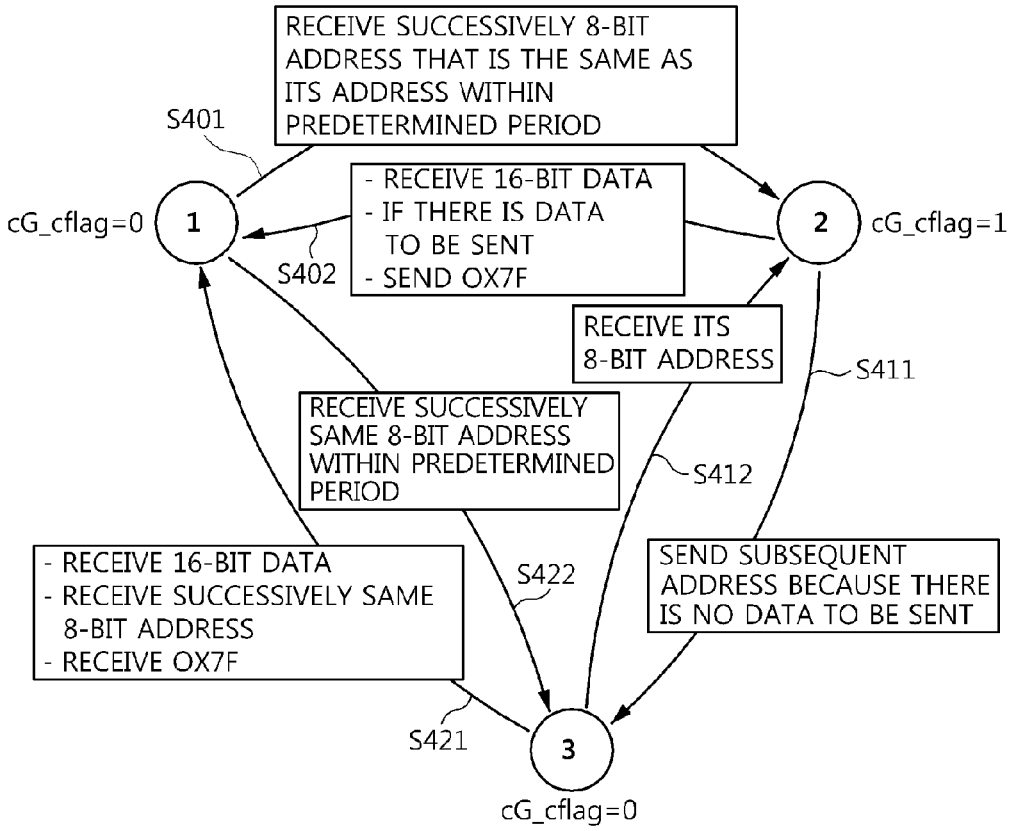
FIG. 4 is a diagram illustrating the state transition of each of the control gears in a single control device environment according to an embodiment of the present invention.

FIG. 4 is a diagram illustrating the state transition of each of the control gears in a single control device environment according to an embodiment of the present invention.

If the control gear has successively received a 8-bit address that is the same as its address in state 1 (cG_cflag=0) in which the right to use the lighting network is possessed by the control device, the control gear transitions to state 2 and sets cG_cflag to 1 in order to indicate that the right to use the lighting network is possessed by the control gear at step S401.

Conversely, in case that the control gear in state 2 has received 16-bit data, if it becomes aware that the control device transfers a command, or if the control gear has data to be sent to the control device or if the control gear sends 0x7F because it is a control gear having a last address, and then transitions to state 1 at step S402.

If the control gear in state 2 assigns the right to use the lighting network to a control gear having a subsequent address because there is no data to be sent, the former control gear transitions to state 3 at step S411.

Furthermore, if the control gear in state 3 has received its 8-bit address, it becomes aware of his turn to use the lighting network and then transitions to state 2 at step S412.

In case that the control gear in state 3 has received 16-bit data, if it becomes aware that the control device transfers a command, or if the control gear has successively received the same 8-bit address twice or if the control gear has received 0x7F, it becomes aware that the right to use the lighting network is possessed by the control device, and then transitions to state 1 at step S421.

Conversely, in order to transition from state 1 to state 3, the control gear should successively receive the same 8-bit address, different from its address, twice at step S422.

Figure 5:
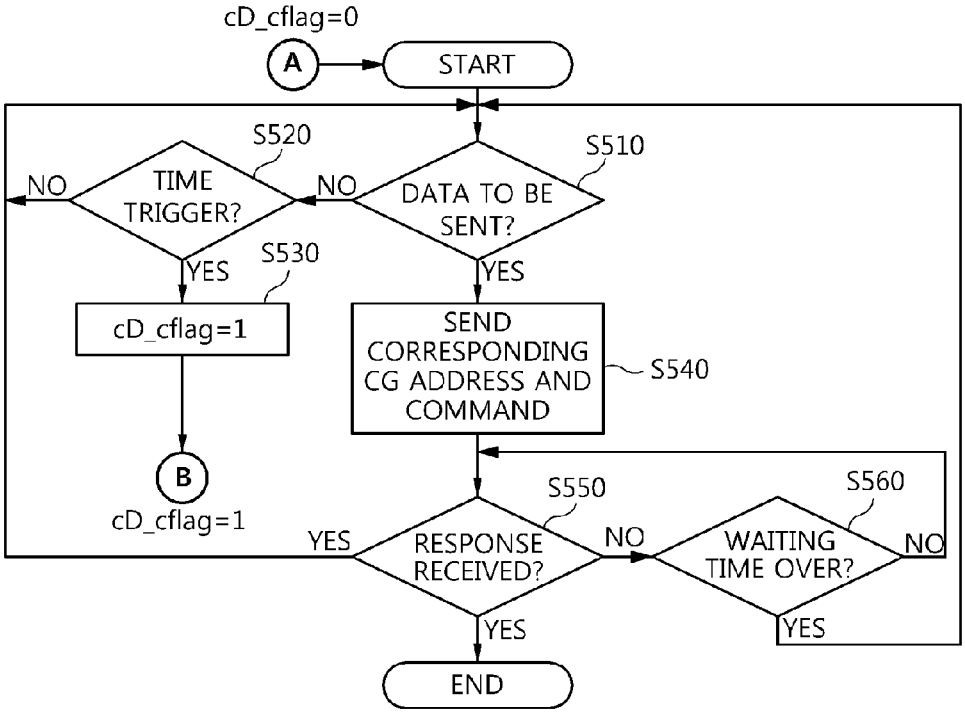
FIG. 5 is a drawing illustrating the operating procedure of the control device in a single control device environment according to an embodiment of the present invention.

FIG. 5 is a drawing illustrating the operating procedure of the control device in a single control device environment according to an embodiment of the present invention.

Referring to FIG. 5, the operating procedure in the case in which the control device is in state A in a single control device environment is illustrated.

The control device in state A first checks whether there is data to be sent at step S510, and, if there is data to be sent, sends the address of a corresponding control gear and a command at step S540, and waits for the receipt of a response until the response is received if the response is necessary at step S550.

If there is no data to be sent and the timer that manages the right to use the lighting network has been triggered at step S520, the control device sets cD_cflag to 1 at step S530, and transitions to state B.

Meanwhile, if a predetermined period has elapsed while waiting for the receipt of the response, the operating procedure starts again from the begging at step S560.

Figure 6:
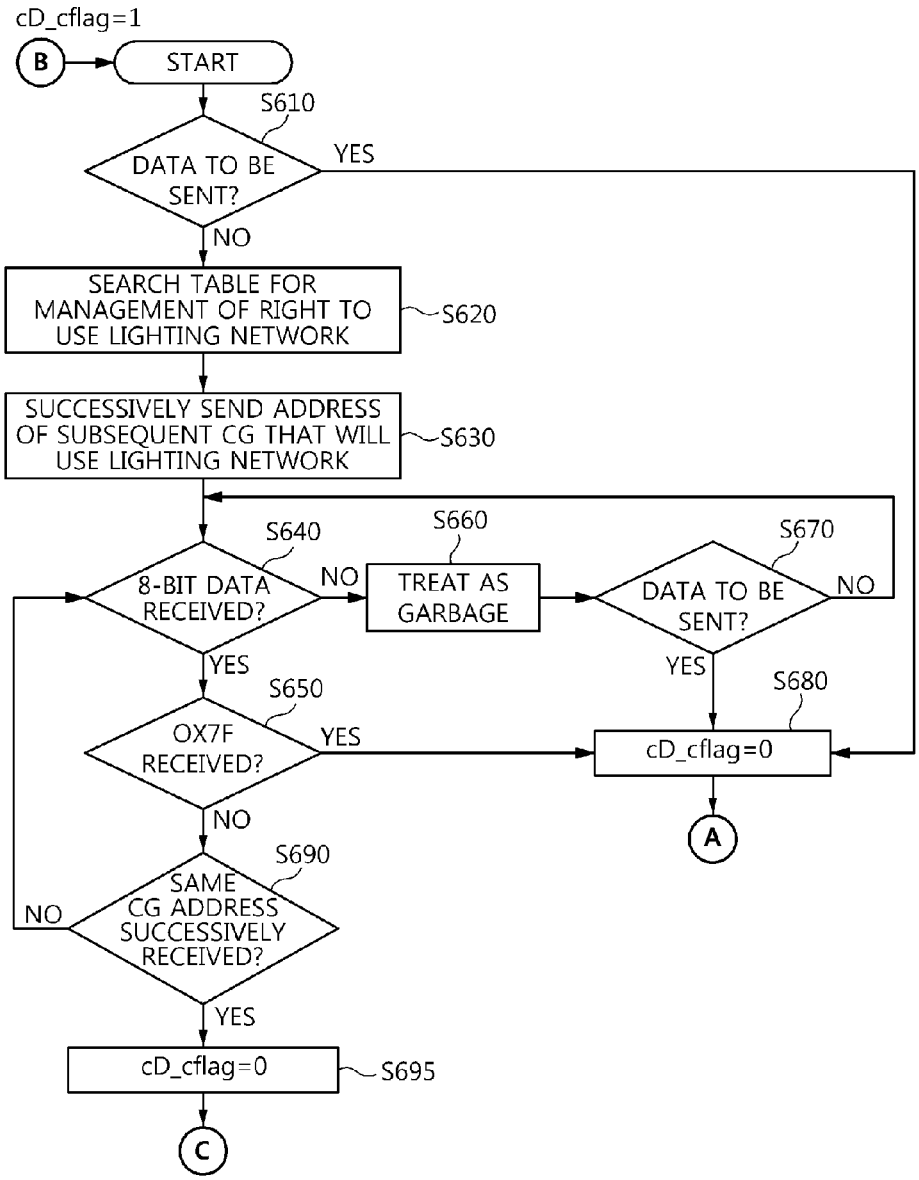
FIG. 6 is a drawing illustrating the operating procedure of the control device in a single control device environment according to an embodiment of the present invention.

FIG. 6 is a drawing illustrating the operating procedure of the control device in a single control device environment according to an embodiment of the present invention.

Referring to FIG. 6, the operating procedure in the case in which the control device is in state B in a single control device environment is illustrated.

The control device checks whether there is a command to control lighting having a high priority at step S610, searches a table that manages the right to use the lighting network at step S620, and successively sends the address of a subsequent control gear that will use the lighting network at step S630.

The control device in state B checks 8-bit data sent from the control gear at step S640, and waits until 0x7F is received at step S650 and, at the same time, checks whether there is a command to control lighting.

If the received data is not 8-bit data, the control device treats the corresponding data as garbage data at step S660, and checks again whether there is data to be sent at step S670.

If a command to control lighting occurs in a waiting state, the control device sets cD_cflag to 0 in order to send the command and transitions to state A at step S680.

Furthermore, if 8-bit data has been successively received from the control gear at step S690, the control device becomes aware that a control gear having a corresponding address has data to be sent, sets cD_cflag to 0, and transitions to state C at step S695.

Figure 7:
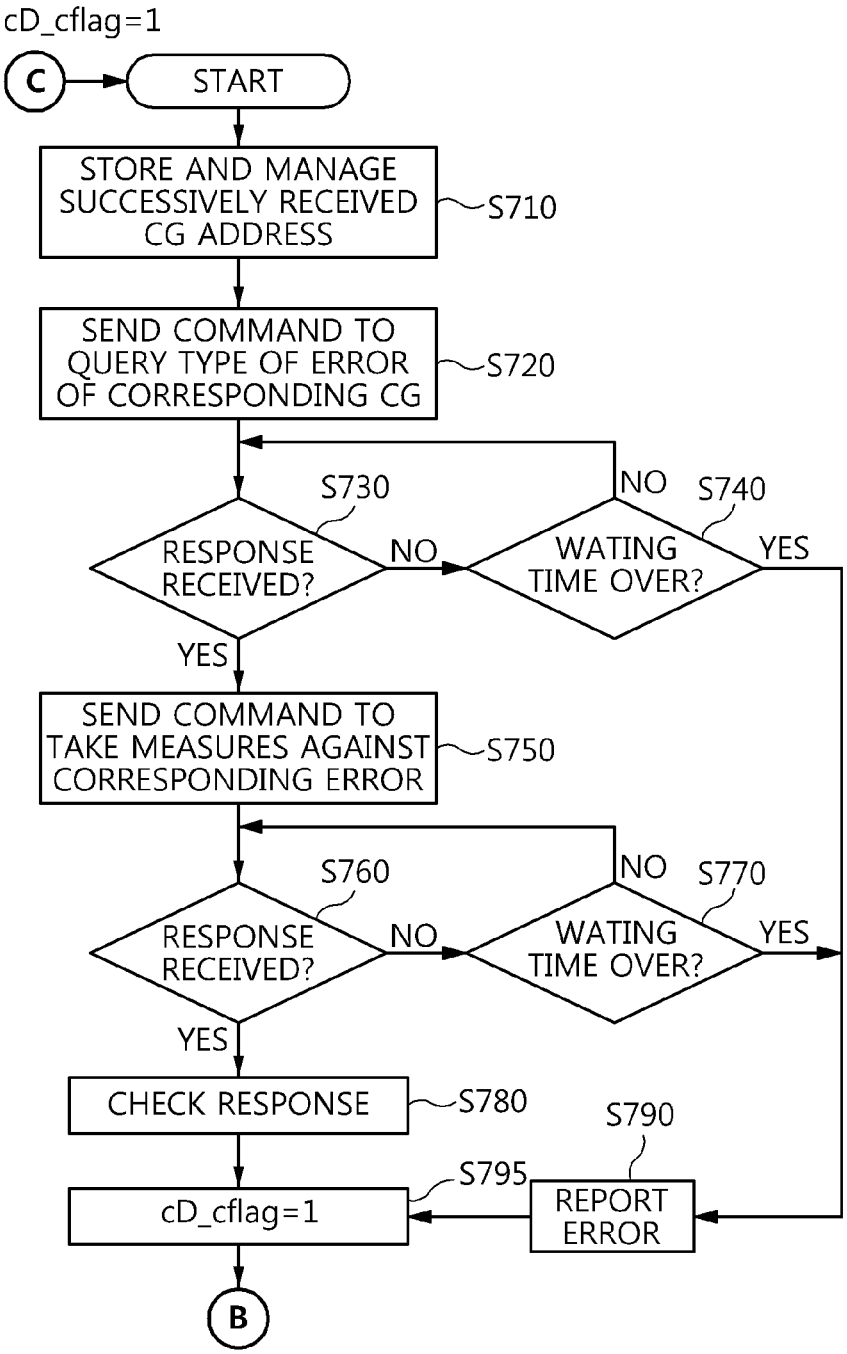
FIG. 7 is a drawing illustrating the operating procedure of the control device in a single control device environment according to an embodiment of the present invention.

FIG. 7 is a drawing illustrating the operating procedure of the control device in a single control device environment according to an embodiment of the present invention.

Referring to FIG. 7, the operating procedure in the case in which the control device is in state C in a single control device environment is illustrated.

The control device checks the successively received control gear address for errors and stores and manages the address of the control gear in order to manage the subsequent control gear that will possess the right to use the lighting network at step S710.

In order to determine the type of error that has occurred in the control gear, the control device sends the address of the corresponding control gear and a command to query the type of error at step S720, and waits for a response thereto at step S730.

If there is a command to deal with the error after the type of error has been determined, the control device transfers the command to the corresponding control gear at step S750, and waits for a response thereto at step S760. If the response has not been received for a predetermined period at step S770, the control device stores and manages information about the fact that there is a problem with the corresponding control gear at step S790, and then transitions to state B at step S795.

Meanwhile, if a response waiting time has elapsed at step S740, the control device stores and manages information about the fact that there is a problem with the corresponding control gear at step S790, and then transitions to state B at step S795.

Figure 8:
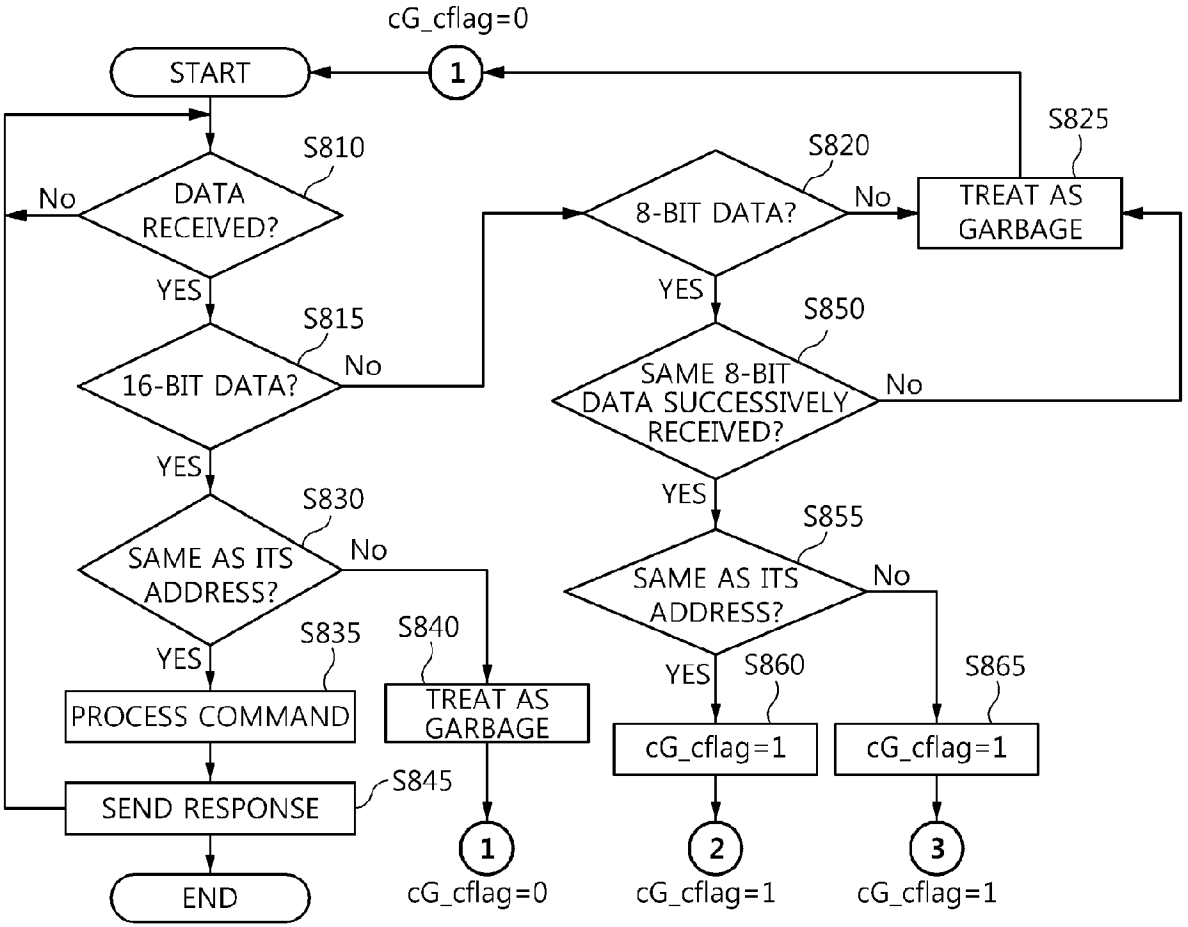
FIG. 8 is a drawing illustrating the operating procedure of the control gear in a single control device environment according to an embodiment of the present invention.

FIG. 8 is a drawing illustrating the operating procedure of the control gear in a single control device environment according to an embodiment of the present invention.

Referring to FIG. 8, the operating procedure in the case in which the control gear is in state 1 in a single control device environment is illustrated.

If the control gear has received 16-bit data at step S815 while waiting for the receipt of data at step S810, the control gear compares the received data with its address in order to determine whether the command transferred from the control device is directed toward it at step S830, and, if it is the same as its address, processes the corresponding command at step S835, and sends a response thereto at step S845.

If the received data is not the same as its address, the control gear treats the corresponding data as garbage and returns to the first state at step S840.

Furthermore, if 8-bit data has been received at step S820 and the same data has been successively received twice at step S850, the control gear becomes aware that the right to use the lighting network has been assigned to one of the control gears. If the corresponding 8-bit data is the same as the address of the control gear at step S855, the control gear transitions to state 2 at step S860. In contrast, if the corresponding 8-bit data is different from the address of the control gear, the control gear transitions to state 3 at step S865. If the received data is not 16-bit or 8-bit data, the control gear treats the corresponding data as garbage. If the pieces of successively received 8-bit data are different from each other, the control gear treats them as garbage at step S825.

Figure 9:
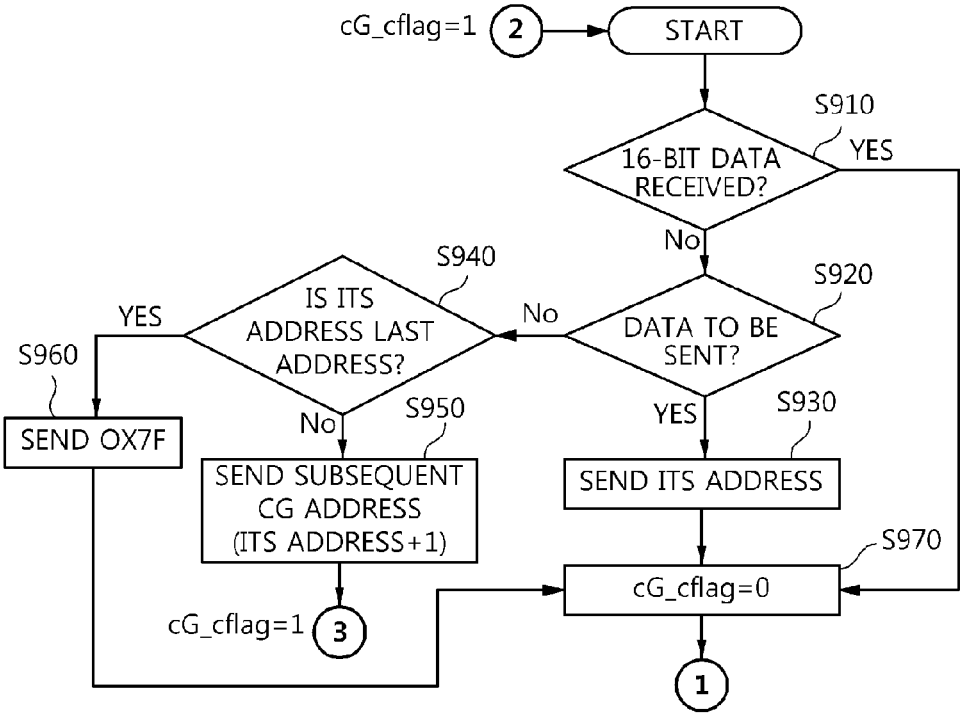
FIG. 9 is a drawing illustrating the operating procedure of the control gear in a single control device environment according to an embodiment of the present invention.

FIG. 9 is a drawing illustrating the operating procedure of the control gear in a single control device environment according to an embodiment of the present invention.

Referring to FIG. 9, the operating procedure in the case in which the control gear is in state 2 in a single control device environment is illustrated.

The control gear first determines whether 16-bit data has been received at step S910, and checks whether there is data that will be sent from the control device at step S920.

If there is data to be sent, the control gear sends its address to the control device at step S930, and transitions to state 1 in order to receive a command from the control device at step S970.

Furthermore, if there is no data to be sent, the control gear performs the procedure of transferring the right to use the lighting network to another control gear. Before transferring the right, the control gear determines whether its address is the last address at step S940. If the address is not the last address, the control gear sends an address obtained by adding 1 to its address and then transitions to state 3 at step S950. If the address is the last address, the control gear sends 0x7F at step S960, the control gear transitions to state 1 at step S970.

Figure 10:
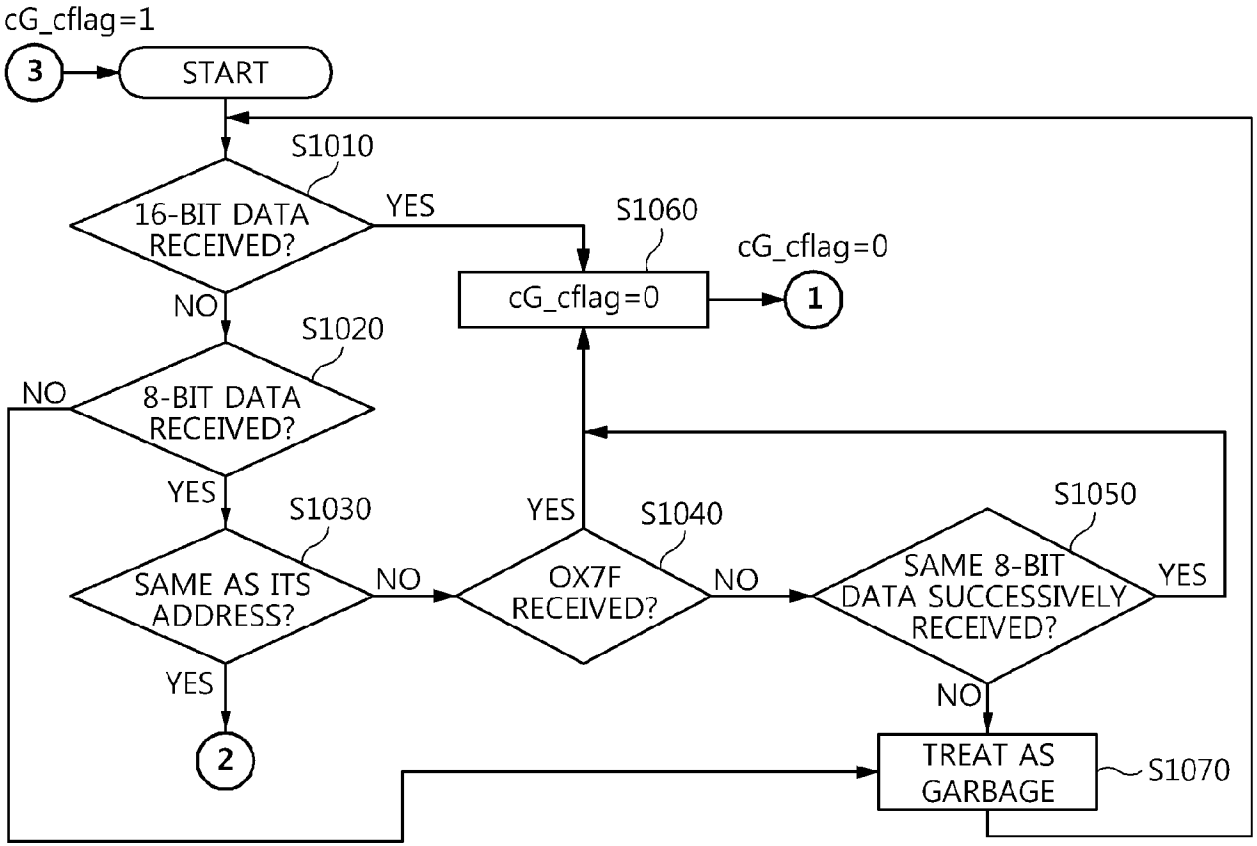
FIG. 10 is a drawing illustrating the operating procedure of the control gear in a single control device environment according to an embodiment of the present invention.

FIG. 10 is a drawing illustrating the operating procedure of the control gear in a single control device environment according to an embodiment of the present invention.

Referring to FIG. 10, the operating procedure in which the control gear is in state 3 in a single control device environment is illustrated.

The control gear checks whether the control device sends a lighting control command having a high priority at step S1010. Here, if 16-bit length data has been received, the control gear transitions to state 1 at step S1060.

If 8-bit data has been received at step S1020, the control gear becomes aware that it is its turn to use the lighting network if the received data is the same as its address and then transitions to state 2 at step S1030.

If the control gear has received 8-bit data of 0x7F in state 3 at step S1040, the control gear becomes aware that the right to use the lighting network has been transferred from the control gear having the last address to the control device and then transitions to state 1 at step S1060.

Alternatively, if the same 8-bit data has been successively received at step S1050, the control gear becomes aware that there is a control gear in which an error has occurred and then transitions to state 1 at step S1060.

Meanwhile, if 16-bit or 8-bit data has not been received or the same 8-bit data has not been successively received, the control gear treats the corresponding data as garbage and starts the operating procedure again from the beginning at step S1070.

According to an embodiment of the present invention, the lighting control device does not transfer commands to determine states to the respective lighting control gears in order to determine the current states and error states of the respective lighting control gears, but assigns the right to use the lighting network to the lighting control gears, so that a lighting control gear whose state has changed or in which an error has occurred actively makes its state report, thereby determining the lighting state almost in real time and also actively dealing with errors.

Furthermore, according to an embodiment of the present invention, a bandwidth that is required to determine the states of lighting control gears can be considerably reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of operating a lighting network control apparatus including a control device and a plurality of control gears, the method comprising:

assigning, by the control device, a right to use a lighting network to a first one of the control gears, wherein the assigning the right to use includes successively sending an address value to the first one of the control gears more than once;

checking, by the first control gear, whether there is data to be sent to the control device, and, if there is data to be sent, sending, by the first control gear, the data to the control device using the right to use the lighting network; and once the data has been sent, assigning, by the first control gear, the right to use the lighting network to another control gear.

2. The method of claim 1, wherein the control gears sequentially assign the right to use the lighting network among the control gears.

3. The method of claim 2, wherein if a last one of the control gears possesses the right to use the lighting network, the last control gear assigns the right to use the lighting network to the control device.

4. The method of claim 1, wherein assigning, by the control device, the right to use the lighting network to the first one of the control gears comprises:

assigning the right to use the lighting network by successively sending, by the control device, an address value of the first control gear to the first control gear.

5. The method of claim 1, wherein the control device operates in one of a mode which is capable of sending commands to the control gears, a mode in which the right to use the lighting network has been assigned to one of the control gears, and a mode in which a report on occurrence of a problem has been received from one of the control gears and a command to check the problem is transferred.

6. The method of claim 1, wherein the control device and the control gears change and set a value of cD_cflag, indicative of possession of the right to use the lighting network, to 0 or 1 depending on the possession of the right to use the lighting network, wherein when the cD_cflag is set to 0, a lightning control device has the right to use the lightning network, and wherein when the cD_cflag is set to 1, the control gears have the right to use the lightning network.

7. The method of claim 1, wherein the control gears each operate in one of a mode in which the right to use the lighting network is currently possessed by the control device, a mode in which the right to use the lighting network has been assigned to one of the control gears and a state report can be made, and in a mode in which the right to use the lighting network is currently possessed by the control gear and a state report cannot be made.

8. An apparatus for controlling a lighting network, comprising:

a control device configured to generate and transfer commands to control lighting; and a plurality of control gears configured to receive the commands from the control device and to control lighting;

wherein the control device assigns a right to use a lighting network to the control gears, and the control gears send information about a change in a lighting state or error details to the control device using the right to use the lighting network, wherein the assigning the right to use includes successively sending an address value to a first one of the control gears more than once.

9. The apparatus of claim 8, wherein the control gears sequentially assign the right to use the lighting network among the control gears.

10. The apparatus of claim 9, wherein if a last one of the control gears possesses the right to use the lighting network, the last control gear assigns the right to use the lighting network to the control device.

11. The apparatus of claim 9, wherein the control device assigns the right to use the lighting network to the first one of the control gears by successively sending an address value of the first control gear to the first control gear.

12. The apparatus of claim 8, wherein the control device operates in one of a mode which is capable of sending commands to the control gears, a mode in which the right to use the lighting network has been assigned to one of the control gears, and a mode in which a report on occurrence of a problem has been received from one of the control gears and a command to check the problem is transferred.

13. The apparatus of claim 8, wherein the control device and the control gears change and set a value of cD_cflag, indicative of possession of the right to use the lighting network, to 0 or 1 depending on the possession of the right to use the lighting network, wherein when the cD_cflag is set to 0, a lightning control device has the right to use the lightning network, and wherein when the cD_cflag is set to 1, the control gears have the right to use the lightning network.

14. The apparatus of claim 8, wherein the control gears each operate in one of a mode in which the right to use the lighting network is currently possessed by the control device, a mode in which the right to use the lighting network has been assigned to one of the control gears and a state report can be made, and in a mode in which the right to use the lighting network is currently possessed by the control gear and a state report cannot be made.

* * * * *